United States Patent [19]

Ball

[11] 4,117,688

[45] Oct. 3, 1978

[54] APPARATUS FOR WORKING UNDER WATER

[75] Inventor: Kenneth Ball, Liverpool, England

[73] Assignee: Vickers-Intertek Limited, London, England

[21] Appl. No.: 685,676

[22] Filed: May 12, 1976

Related U.S. Application Data

[62] Division of Ser. No. 456,769, Apr. 1, 1974, Pat. No. 3,968,656.

[51] Int. Cl.[2] ..... B63C 11/00

[52] U.S. Cl. ..... 405/188; 405/193

[58] Field of Search ..... 61/1 F, 69 R, 69 A; 166/0.5, 0.6

[56] References Cited

U.S. PATENT DOCUMENTS

| | | | |
|---|---|---|---|
| 3,670,814 | 6/1972 | Childers | 61/1 F X |
| 3,745,773 | 7/1973 | Cunningham | 61/1 F X |
| 3,851,487 | 12/1974 | Lambertsen | 61/69 R |
| 3,855,806 | 12/1974 | Therisien | 61/69 R |
| 3,864,924 | 2/1975 | Piotin | 61/69 R |

*Primary Examiner*—Mervin Stein
*Assistant Examiner*—David H. Corbin
*Attorney, Agent, or Firm*—Scrivener, Parker, Scrivener & Clarke

[57] ABSTRACT

A capsule for enclosing a sub-sea installation part is intended to be left water-filled and thus means for sensing oil or gas leaks from the part is disposed in the upper part of the capsule to where such leakage will float.

5 Claims, 9 Drawing Figures

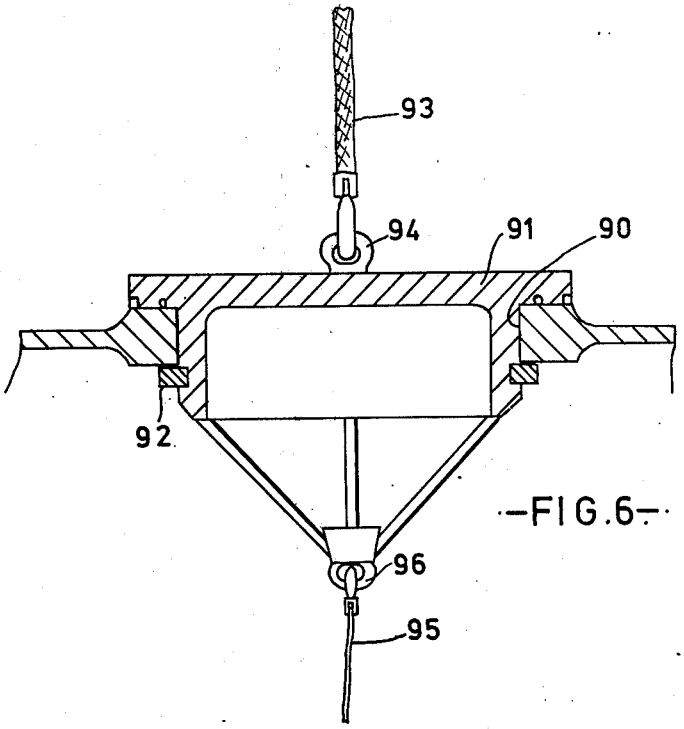
-FIG.6-
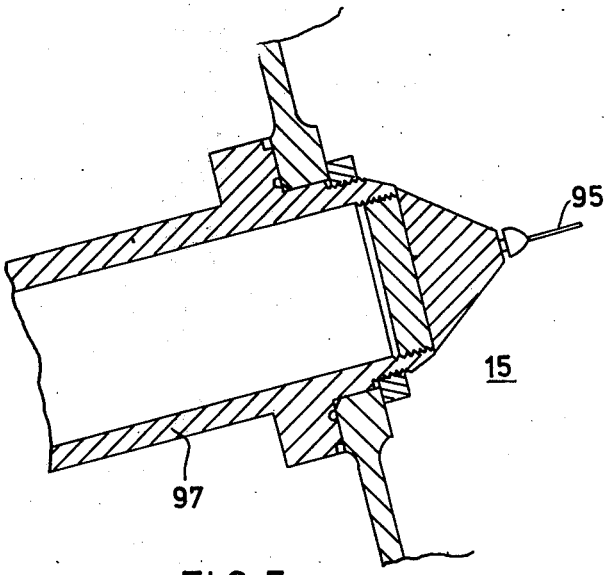
-FIG.7-

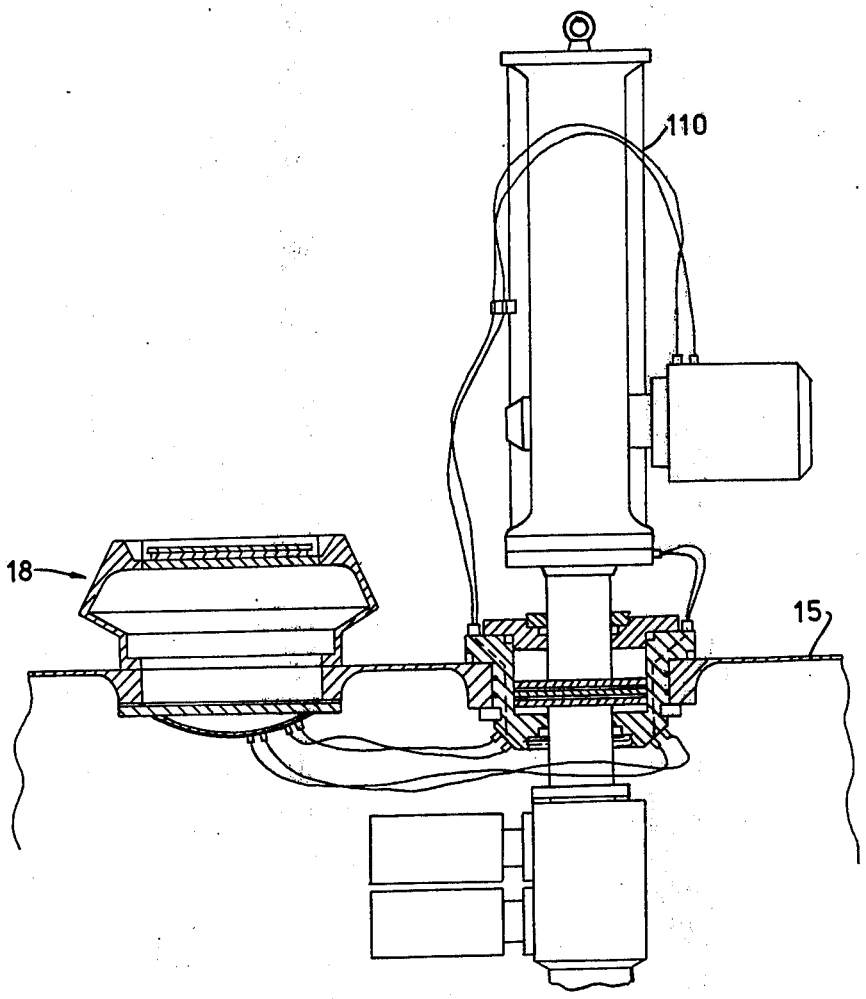
—FIG.8.—

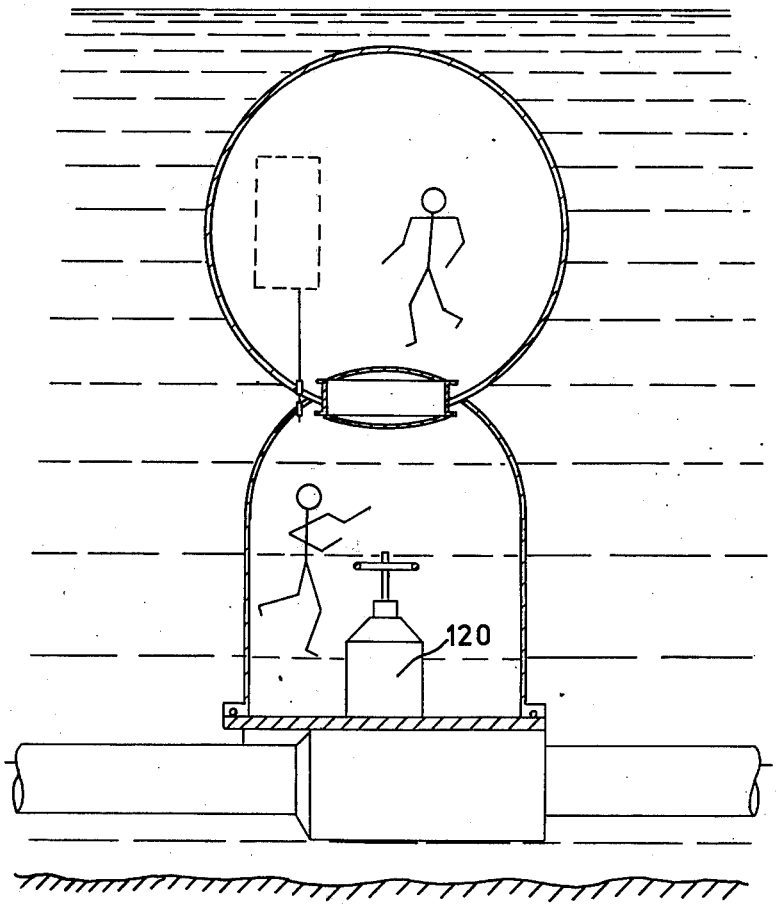
—FIG. 9.—

APPARATUS FOR WORKING UNDER WATER

This is a division of application Ser. No. 456,769 filed Apr. 1, 1974, now U.S. Pat. No. 3,968,656.

The present invention concerns a method of working under-water and apparatus therefor.

There is a problem in working under-water on the erection and maintenance of sea-bed installations such as oil-well heads. With conventional diving and diving-bell techniques, the personnel are subject to the hydrostatic pressure head corresponding to the water depth and, due to the need to decompress to avoid the bends, their working day is very short. It has been proposed to enclose parts of the sea-bed installation within capsules filled with air or another gas at atmospheric pressure and to bring the personnel down to such capsules within other capsules filled with air at atmospheric pressure; the transfer of personnel involved having mating means on the capsules which formed water-filled conjunction capsules which had to be pumped out or drained into the installation part capsules (which in turn had to be pumped out) and filled with air at atmospheric pressure. This pumping involved the transfer of large volumes of water equal to the volumes of the conjunction capsules against the full hydrostatic pressure head. This pumping out is a heavy duty pumping requirement and involves large amounts of power and is time consuming. It is difficult to make the transit capsule self-sufficient and it is necessary to supply the power from surface support ships. Any parts to be installed must be transported within the transit capsules or so as to be within the conjunction capsules; the alternative is to flood the installation part capsules which then have to be pumped out again. Whenever a pipe or electrical connection has to be made through a wall of an installation part capsule, it is necessary to flood the capsule and subsequently pump it out or use elaborate lock-through arrangements.

Also any leakage of oil tends to collect in the bottoms of the installation part capsules with the result that if the installation part capsules are subsequently flooded the oil smears itself over the installation part. Moreover if a leak occurs when men are inside an installation part capsule the leak takes the form of a high pressure jet of sea-water.

In the subsequent parts of this specification, atmospheric pressure means any pressure accepted by medical opinion as safe for working without the need for lengthy decompression and typically includes up to a pressure corresponding to ten meters less the depth of water in the capsules.

The present invention provides a capsule for enclosing part of a sub-sea installation and enclosing leakage detection means characterised in that the leakage detection means is located within an upper part of the capsule so that if the capsule is filled with water any leakage will float into the upper part and be detected therein.

The capsule according to the present invention is intended for use with the method of U.S. Pat. No. 3,968,656 and will in use be full of water which during manned intervention will be at atmospheric pressure but preferably between interventions is an external sea pressure.

Embodiments of the invention will now be described, by way of example, with reference to the accompanying drawings.

THE DRAWINGS

Figure 3:
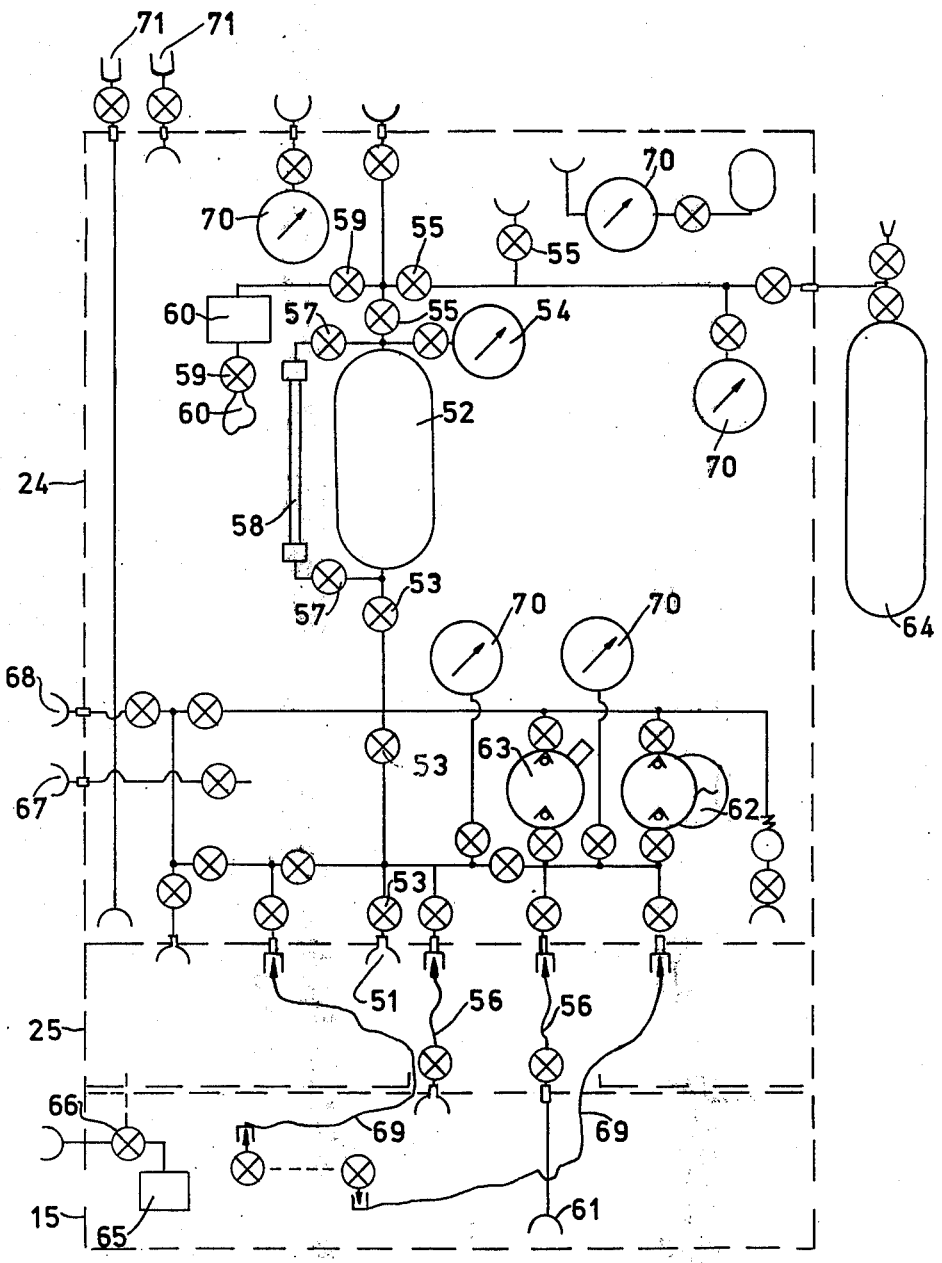
Figure 4:
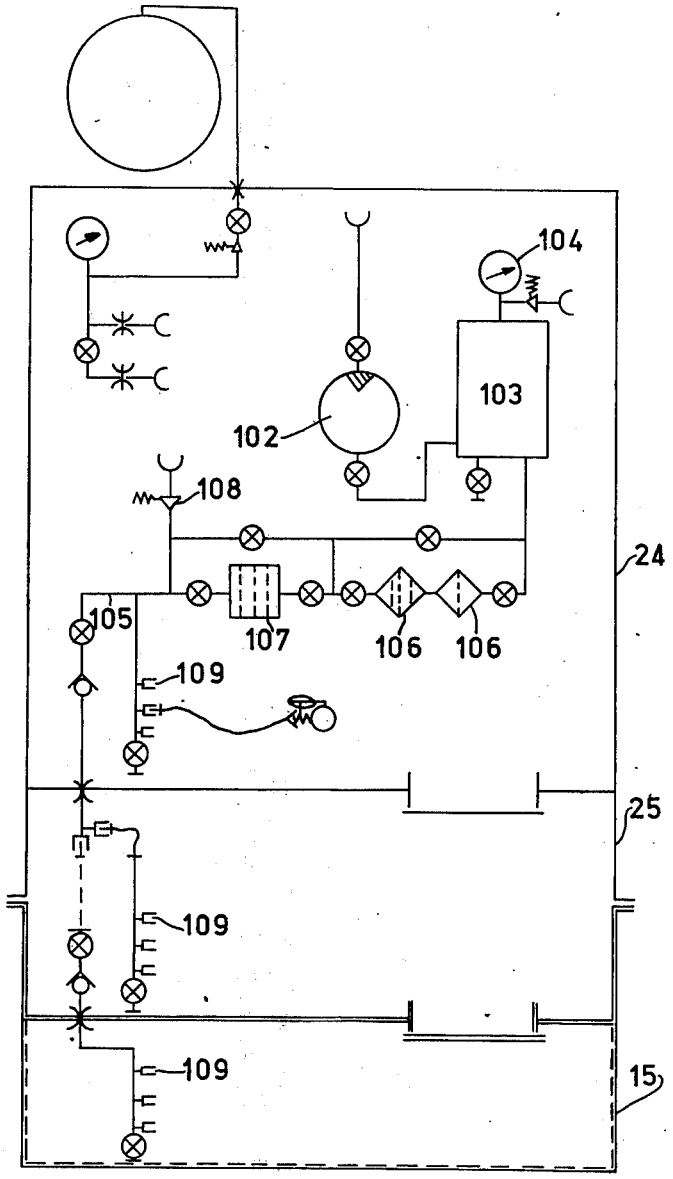
Figure 5:
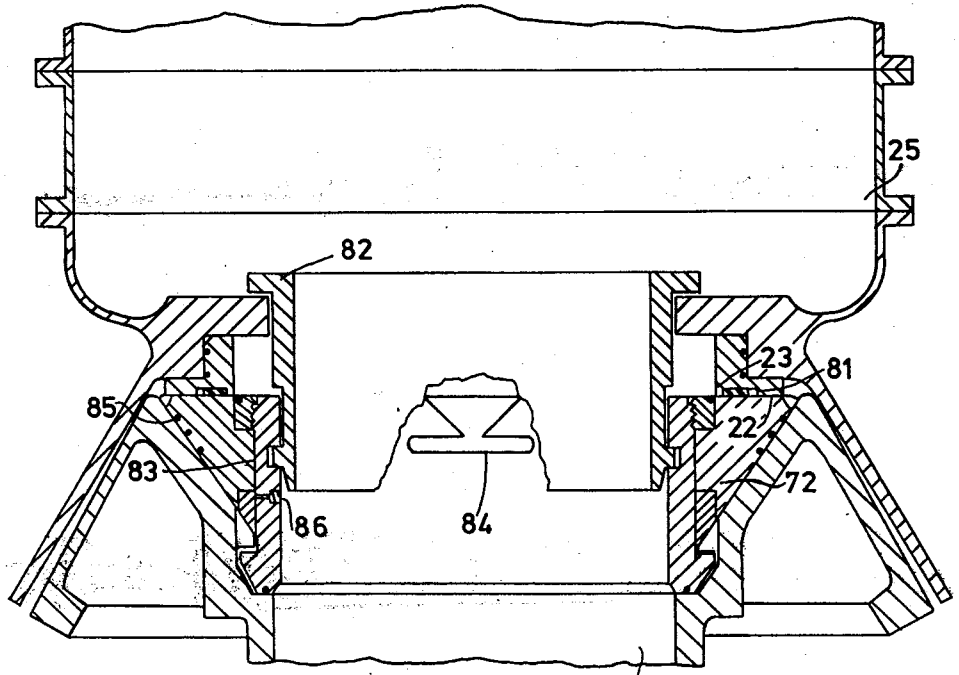

FIG. 3 is a schematic circuit diagram showing means for regulating water pressure in various schematically shown capsules, FIG. 4 is a schematic circuit diagram of a preferred arrangement for providing a breathing supply to personnel working within the installation part capsule, FIG. 5 shows means for effecting a seal between the transit capsule and the installation part capsule together with means for testing and maintaining the seal, FIG. 6 shows a removable cover plate in the wall of the installation part capsule, FIG. 7 shows means for connecting auxiliary equipment through the wall of the installation part capsule and sealing thereto, FIG. 8 shows an external unit fitted to the installation part capsule, and FIG. 9 illustrates a simplified second version of the invention.

DETAILED DESCRIPTION OF THE EMBODIMENTS

Figure 1:
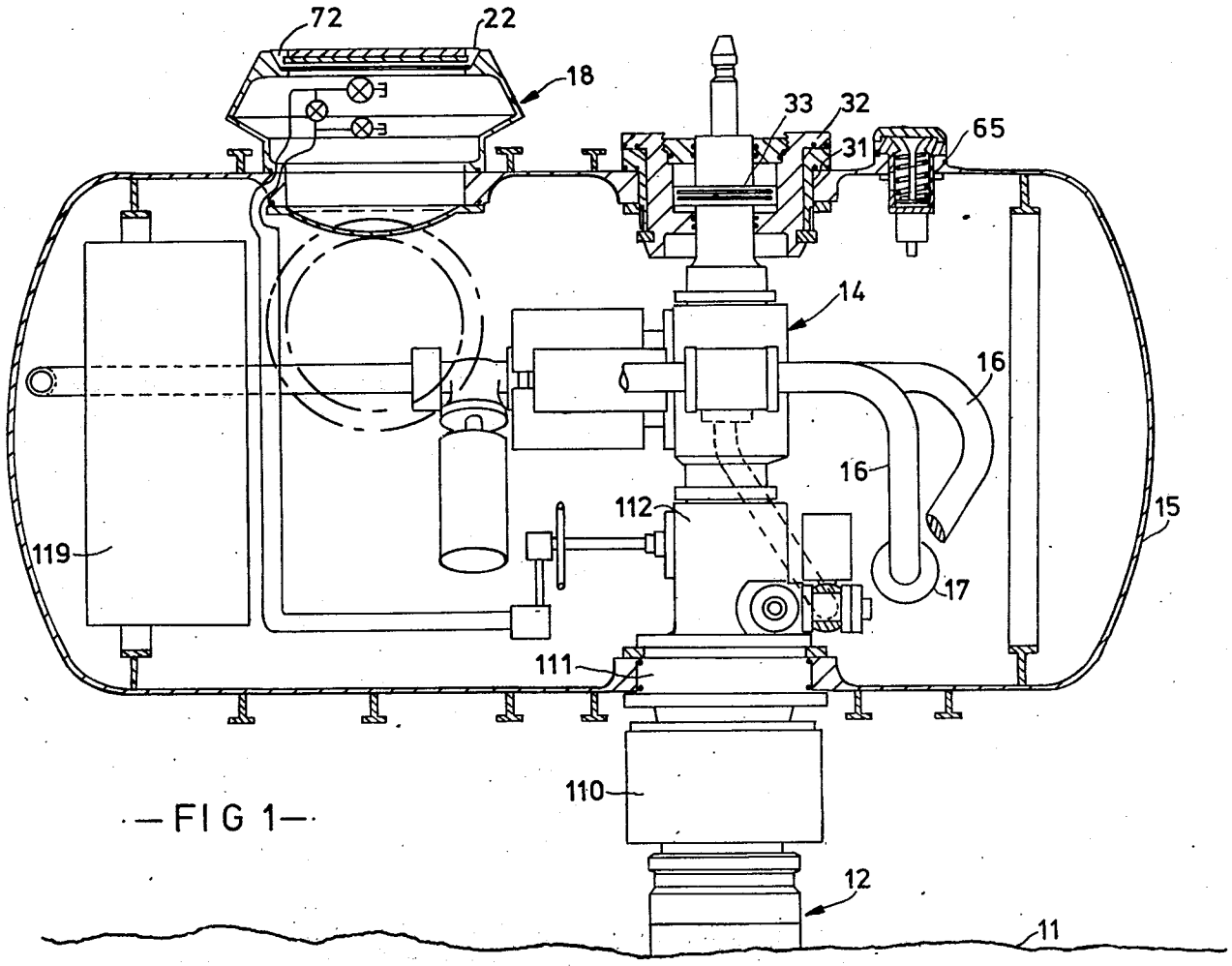
FIG. 1 shows part of a sea-bed installation enclosed in a capsule.

FIG. 1 shows a portion of a sea-bed 11 from which projects the well head casings 12. On the casings is mounted a christmas tree 14 which is enclosed in a sealed installation part capsule 15. Pipes 16 are brought through suitable connectors 17 in the wall of the capsule to connect up to the christmas tree. A hatch 18 is provided on the top of the capsule. The well head casings terminate in known manner in a connector 110 and an adapter 111. The seals between the casings and the adapter may leak. In embodiments of the present invention, these seals are outside the capsule. The adapter is a solid block which penetrates the capsule wall and contains a master valve 112 which can be operated manually or by remote hydraulic means which are arranged not to interfere with each other.

Figure 2:
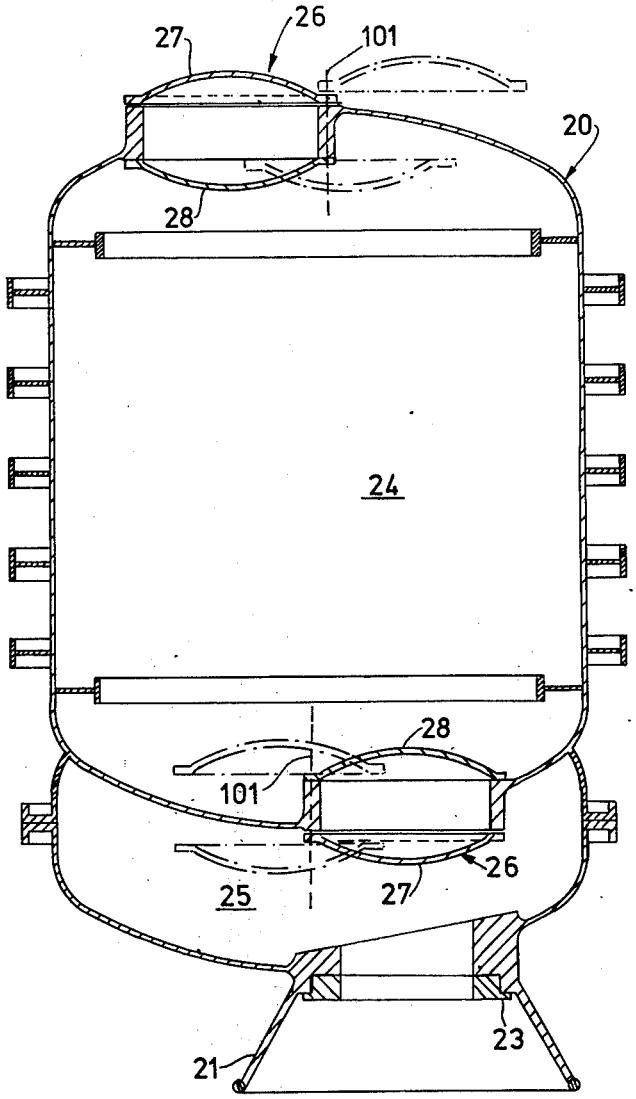
FIG. 2 shows a transit module.

FIG. 2 shows a transit module 20 which can be guided down to the capsule 15 by any of the known means such as guide wires (not shown). At the bottom of this module, there is an entry fairing 21 to receive the hatch 18 and guide a sealing surface 22 around the hatch onto a complementary sealing surface 23 on the module 20.

The module 20 comprises an upper, transit, capsule 24 and a lower chamber which is normally open at its lower end at the fairing 21 but which is sealed by the co-operation of the sealing surfaces to form a third, conjunction, capsule. The chamber will hereinafter be referred to as the capsule 25.

The capsule 24 has double hatches 26 at its lower and upper ends. The upper double hatch is for the entry of personnel and equipment at the sea-surface and the lower double hatch is to give access to the conjunction capsule 25. The double hatches are designed with an outer member 27 to resist external pressure and an inner member 28 to resist pressure within the capsule 24; this allows the capsule to be used normally and as a decompression chamber if the capsule by any mishap becomes pressurised whilst containing personnel as might occur if a leak commenced when personnel were in the capsule 15 and the lower double hatch had to remain open to allow them to re-enter the capsule 24. The personnel could then seal themselves into the capsule at whatever pressure existed and escape to the surface relying on the air in the capsule 24 and possibly external connectors for enabling support vessels to supply further air when on the surface but before it would be safe to leave the capsule because of insufficient decompression. The members of each double hatch pivot about a single pin 101 parallel to the axis of the hatch.

The hatch 18 can be designed to resist major pressure within the capsule 15 only since the capsule is preferably at full hydrostatic pressure except when the pressure across this hatch is balanced at atmospheric pressure.

The christmas tree 14 projects through the capsule 15 being rigidly sealed to the bottom of the capsule and being slidably sealed in a port 31 at the top of the capsule to allow for relative expansion and to allow for connection of wire-line or other auxiliary units 110 (FIG. 8) which would be at the top of the tree. The form of this sliding seal is a rigid collar 32 fast to the port 31 within which collar there is a piston 33 which can be used as a hydrostatic bearing and as a jack to lift elements of the tree of their seatings prior to being removed.

FIG. 3 shows a circuit diagram of means for regulating water pressures. This Figure is rather complex due to the large amount of designed redundancy and it is thought best described by an explanation of how it is used. First it is to assumed that the three capsules 15, 24 and 25 (shown in this Figure in broken lines) are filled, capsule 24 with air at atmospheric pressure and the other two capsules with water at external pressure. A pressure bleed 51 is connected to an expansion tank 52 by means of valves 53. The pressure bleed is provided in or by-passing the lower double hatch 26. The expansion tank is a pressure vessel and initially its pressure rises as sensed by a pressure gauge 54. If there is a leak on the sealing surfaces 22 and 23 the pressure would rise to the external pressure. However normally the pressure rise will be limited indicating the absence of any leak and the expansion tank can be vented to the transit capsule pressure by valves 55. The double hatch can now be opened and access gained to the conjunction capsule 25 to enable flexible connections 56 to be made to the capsule 15 through or by-passing the hatch 18. One of these connections is a pressure bleed and this again is routed by the valves 53 to the expansion tank 52 except that the initial flow is by-passed by valves 57 through a sight glass 58 so that the nature of the flow can be observed and possibly by valves 59 to analytical apparatus 60. If the flow is oil or gas, it is possible to flush any remaining oil or gas from the capsule 15 by pumping water through the other of the flexible connections 56 to an outlet 61 below the expected lowest level of gas or oil by a power driven pump 62 or a hand driven pump 63. This oil or gas would result from a leakage from the well head installation and can be severely limited by means 65 which comprises any one or combination of an oil detector, a gas detector, a differential pressure detector, a pressure relief valve and a frangible diaphragm. This means is disposed in the upper part of the capsule 15 which is so arranged as to provide an oil and gas catchment area around the means. Any detectors used in the means are arranged to prevent further leakage by closing off the well head either by direct mechanical operation or by electrical or hydraulic connections. Preferably the means, or some of it, is disposed to be accessible for closing off purposes from the conjunction capsule. If a pressure relief valve or diaphragm is used, a valve 66 operable from within the capsule 25 is used to isolate the relief valve or diaphragm from the external pressure to allow the pressure relief valve or diaphragm to be serviced. The water which is pumped through the outlet 61 is drawn from a sea connection or possibly from the tank 52 and discharged through another sea connection 68 or a pressure relief valve in the means 65; if oil pollution is to be minimised, it is possible to store the flushed oil in the tank 52 or another tank. In cases where it is impossible to limit the amount of oil leakage, it would be possible to have a diving-bell-like collector to receive any oil coming from the sea connection 68. After all the oil and gas has been flushed out, the pressure in the capsule can be reduced as described in relation to capsule 25 and the hatch opened. Access can then be gained to the well head installation. Since this is still immersed in water which can be fifteen foot deep, it is necessary to have shallow water diving support means, i.e. an air supply system including a compressor 102 (FIG. 4) so that the personnel do not have to suck air against the pressure head of the water in the capsule 15. Each person has a demand valve in his breathing equipment to reduce the air pressure to that required at his working depth. Since even if the capsule 15 becomes pressurised whilst occupied, the pressures in the other capsules will increase by the same amount, the pressure head generated by the compressor does not have to be large. The compressor 102 draws in air from the transit capsule and delivers it to a reservoir 103 controlled by a settable relief valve 104 and thence to a breathing manifold 105 through filters 106 and carbon dioxide absorbing means 107. The pressure in this manifold is controlled by a valve 108. Suitable connecting points 109 for drawing off air are provided on the manifold.

FIG. 3 also illustrates flexible connections 69 which can be used to flush equipment within the capsule 15 if required pressure gauges 70 and external connections 71 to enable the capsule 24 to be used as a decompression chamber or diving bell.

So far it has been assumed that the pressure in the capsule 25 can be reduced. The only reason for the pressure in the capsule 25 not to reduce is a leak on the sealing surfaces 22 and 23. One of these surfaces contains a compressible seal 81 which is arranged to be compressed sufficiently for the surfaces 22 and 23 to limit the amount of leakage if the seal 81 fails. The module 20 has a rotatable collar 82 having projections 83 for gripping in T-shaped slots 84 in a ring 72 containing the surface 22 and removing the ring 72 to the surface along with the module 20. At the surface the sealing surfaces can be rectified possibly by replacing the ring 72 which has compressible seals 85 on its lower surface. When the ring 72 has been rectified or replaced it can be brought down on the module 20 and the lower surface sealed. The seals on the lower surface are rendered permanent by sealants and/or inhibitors injected through ducts 86 (which can in turn be sealed by plugs) and this time the ring 72 should give a good seal so that the capsule 25 can be reduced in pressure.

Various functions can be performed from maintenance up to the erection of the christmas tree and making external connections. When the capsule is initially installed using divers or diving bells, it may consist of the bare shell which is attached by the divers to the well head casings, the christmas tree not yet being installed. The holes in the shell such as the port 31 and ports 90 (FIG. 6) for the entry of the pipelines are blanked off from the outside by removable cover plates 91 whose securing means 92 are access accessible from the inside of the shell. These cover plates are arranged so that even in the absence of the securing means the external pressure will cause the cover plates to make a seal with the rest of the shell. Thus the shell immediately after installation can be used to provide a safe working environment for personnel to erect the christmas tree. When a new part of the christmas tree is to brought within the shell, it is possible to bring down the new part within the transit capsule as in the prior art. However because of the low depressurisation time required, it is possible for personnel from the transit capsule to release the securing means of a plate over a port 90, buoy the cover plate by means of a hawser 93 and an eyebolt 94 and attach a haul-down hawser 95 to an eyebolt 96. They can then return to, and seal themselves inside the transit capsule and repressurise the capsule 15 so that the cover plate is expelled from its seating and can be recovered by a support ship. A new part and the cover plate or, for example a pipe 97 (FIG. 7) can then be arranged on the hawser 95 and the hawser drawn in by a winch in the capsule 25 operated from within the capsule 24 so that the cover plate or pipe flange is drawn tight back on its seating with the new part within the capsule 15. The personnel can then reduce the pressure in the capsule 15 to regain access thereto and secure the pipe flange or to resecure the cover plate and fit the new part.

Some parts of the well head installation may be connected by flexible leads to the christmas tree and be removably secured within the capsule 15 so that they can be drawn up into the transit capsule for maintenance in a dry environment. Such a part is a control panel 119 (FIG. 1).

After the maintenance or installation function is completed the personnel return to the transit capsule sealing the hatches behind them and repressurising the equipment part and conjunction capsules. The transit capsule then returns to the sea-surface.

In this Specification and the apended claims, a capsule means a shell capable of resisting pressure exerted by the external seal water when the pressure inside the shell or capsule is reduced to atmospheric.

I claim:

1. A sub-sea capsule comprising a hollow body which is adapted in its position of use to surround a sub-sea installation and be at all times water filled with the pressure of water in said capsule varying between pressure equal to external sea pressure and substantially atmospheric pressure depending on whether the interior of said sub-sea capsule is exposed to external sea pressure or to substantially atmospheric pressure of a transit capsule connected to said sub-sea capsule, said sub-sea capsule being resistant to external sea pressure when the pressure of water filling said capsule is at substantially atmospheric, means associated with said capsule permitting mounting thereof in sealed relationship around an installation, means carried by said capsule for cooperation with complementary means on a transit capsule to form access means between said sub-sea capsule and said transit capsule, and leak detection means located within the upper part of said capsule for detecting any leakage floating up from an installation through water filling said capsule when the latter is in its position of use surrounding said installation.

2. The sub-sea capsule of claim 1 including pressure relief means carried by said capsule for preventing pressure therein from significantly exceeding the external sea pressure.

3. The sub-sea capsule of claim 2 including inlet means carried by said capsule for enabling water to be pumped into the capsule to flush any leakage therefrom, said pressure relief means being disposed in said upper part and being constructed and arranged to provide an exit for flushing water delivered to said inlet.

4. The sub-seal capsule of claim 2 wherein the access means comprises a hatch, a removable sealing member surrounding said hatch having a first sealing surface for cooperating with the complementary means on the transit capsule and having a second sealing surface for sealing on to said sub-sea capsule, and means for releasably securing the sealing member to said sub-sea capsule.

5. The sub-sea capsule of claim 1 including port means in the wall of said capsule spaced from said access forming means, and cover plate means for said port means.

* * * * *